US006909788B2

(12) United States Patent
Ishigaki et al.

(10) Patent No.: US 6,909,788 B2
(45) Date of Patent: Jun. 21, 2005

(54) SPEAKER VOICE COIL BOBBIN AND METHOD OF MANUFACTURING SAME

(75) Inventors: Toshihiro Ishigaki, Yamagata-ken (JP); Tomoyuki Shimada, Kanagawa-ken (JP)

(73) Assignees: Pioneer Corporation, Tokyo (JP); Tohoku Pioneer Corporation, Yamagata (JP); Nippan Kenkyujo Co., Ltd., Kanagawa (JP)

( * ) Notice: Subject to any disclaimer, the term of this patent is extended or adjusted under 35 U.S.C. 154(b) by 24 days.

(21) Appl. No.: 10/108,557

(22) Filed: Mar. 29, 2002

(65) Prior Publication Data

US 2002/0141609 A1 Oct. 3, 2002

(30) Foreign Application Priority Data

Apr. 2, 2001 (JP) ..... 2001-103118

(51) Int. Cl.[7] ..... H04R 1/00
(52) U.S. Cl. ..... 381/407

(58) Field of Search ..... 381/407, 410, 381/409

(56) References Cited

FOREIGN PATENT DOCUMENTS

| | | | | |
|---|---|---|---|---|
| JP | 63149995 | * 6/1988 | ..... | H04R/9/04 |
| JP | 02295399 | * 12/1990 | ..... | H04R/9/04 |
| JP | 04170900 | * 6/1992 | ..... | H04R/9/04 |
| JP | 10-013996 | * 1/1998 | ..... | H04R/9/04 |

* cited by examiner

*Primary Examiner*—Curtis Kuntz
*Assistant Examiner*—Brian Ensey
(74) *Attorney, Agent, or Firm*—Arent Fox PLLC

(57) ABSTRACT

A voice coil bobbin 1 is formed from a material combining a fiber-type material and a ceramic-type-coating agent including metal alkoxide, metal hydroxide, and a colloidal or fine-particulate inorganic substance. The combining process for the ceramic-type-coating agent is performed before or after the fiber-type material is formed into a shape of the voice coil bobbin 1.

6 Claims, 5 Drawing Sheets

FIG.2

| COMPOSITION OF CERAMIC-TYPE-COATING AGENT (PART BY WEIGHT IN SOLID) | | COMPOSITION EXAMPLE 1 | COMPOSITION EXAMPLE 2 | COMPOSITION EXAMPLE 3 |
|---|---|---|---|---|
| ALKOXY METAL | TETRAETHYL SILICATE (42) | | 15(6. 3) | |
| ALKOXY METAL | TETRABUTYL SILICONATE (33) | | 5(1. 6) | |
| ORGANOALKOXY METAL | TRIMETHYLMETHOXYSILANE (48) | 30(14. 4) | | |
| SILICONE VARNISH | METHYL SILICONE VARNISH (55) | | 45(24. 7) | |
| ALKALI METAL SALT | LITHIUM SILICATE (21) | | | 40(8. 4) |
| SILICONE VARNISH EMULSION | METHYL SILICONE EMULSION (48) | | | 25(12. 0) |
| COLLOIDAL INORGANIC SUBSTANCE | AQUEOUS COLLOIDAL ALUMINA (20) | 45(9. 0) | | |
| FINE-PARTICULATE INORGANIC SUBSTANCE | IRON-COPPER-MANGANESE SYNTHETIC OXIDE—AVERAGE PARTICLE DIAMENTER 0. 5 μ | | 5(5. 0) | 2(2. 0) |
| FINE-PARTICULATE INORGANIC SUBSTANCE | ALUMINUM HYDROXIDE-AVERAGE PARTICLE DIAMENTER1 μ | | | 8(8. 0) |
| ORGANIC SOLVENT | ISOPROPANOL | 25 | | |
| ORGANIC SOLVENT | n—BUTANOL | | 30 | |
| WATER | ION-EXCHANGED WATER | | | 25 |
| TOTAL | | 100 | 100 | 100 |
| (TOTAL SOLIDS CONTENT) | | 23. 4 | 37. 6 | 30. 4 |
| SURFACE ACTIVE AGENT | SILICONE-TYPE LEVELING AGENT | 0. 5 | | 0. 5 |
| ACETIC ACID | | | 1. 0 | |

( )NUMERALS INSIDE PARENTHESES ARE PART BY WEIGHT IN SOLID

FIG.3

| | THICKNESS (mm) | SPECIFIC GRAVITY ( g/cm$^3$) | YOUNG'S MODULUS ($\times 10^9$N/m$^2$) | INTERNAL LOSS |
|---|---|---|---|---|
| CONVENTIONAL ART1 (HEAT-RESISTANT RESIN FILM OF POLYIMIDE) | 0.08 | 1.50 | 4.6 | 0.021 |
| CONVENTIONAL ART2 (GLASS CLOTH) | 0.08 | 1.24 | 1.6 | 0.032 |
| PRESENT INVENTION (IMPREGNATING GLASS CLOTH WITH ALKOXY METAL) | 0.10 | 1.26 | 4.5 | 0.019 |

SPEAKER VOICE COIL BOBBIN AND METHOD OF MANUFACTURING SAME

BACKGROUND OF THE INVENTION

1. Field of the Invention

The invention relates to a configuration of a speaker voice-coil bobbin and a method of manufacturing the speaker voice coil bobbin.

The present application claims priority from Japanese Application No. 2001-103118, the disclosure of which is incorporated herein by reference for all purposes.

2. Description of the Related Art

Conventionally, as a base material for forming a bobbin on which a voice coil of a speaker is wound, a paper material such as kraft paper, a heat-resistant resin film made of polyimide, polyamide or the like, metal foil made of aluminum or the like, and other such materials are employed.

The reason why paper material is employed as the base material of the speaker voice-coil bobbin is because of its light weight and low cost. However, the voice-coil bobbin formed from the paper material has the problem that it is flammable due to its low heat resistance and has inferior heat-dissipation properties.

Accordingly, when an abnormal current flows through the speaker or when abnormal heating occurs on the periphery of the speaker, there may be cases where an accidental fire originates in the voice-coil bobbin and spreads.

In addition, the voice-coil bobbin formed of the paper material is of inferior humidity resistance and water resistance. The absorption of water or moisture by the paper material causes degradation in the binding between the fibers, resulting in a decrease in strength.

Therefore, the paper-material-made voice-coil bobbin has a problem that it is unfit for speakers placed in harsh use-environments where water may be directly poured on the speaker or in humid surroundings, e.g., a vehicle-mounted speaker.

The paper material also has the disadvantage of low rigidity.

The heat-resistant resin film made of polyimide, polyamide or the like is employed in order to solve the problems associated with the paper material, but it has the different problems of high cost, inferior adhesion properties and dissolution at high temperatures.

The voice-coil bobbin employing metal foil made of aluminum or the like in order to solve the problems associated with the paper material has high heat resistance, but also high specific gravity as compared with that of the paper material and the resin, and high thermal conductivity. Hence, heat generated in the voice coil is propagated through the entire bobbin, which causes the possibility of the melting or ignition of an adhesive for fixing the parts attached to the voice coil, such as a diaphragm, center cap and damper, and also fixing the parts to each other. As a result, the use of such a metal foil is attended with the problem that the materials for the parts and the like need to have high heat resistance.

SUMMARY OF THE INVENTION

The present invention has been made to solve the aforementioned problems associated with the conventional speaker voice-coil bobbins.

It is therefore a first object of the present invention to provide a speaker voice-coil bobbin which has light weight, low cost, high heat-dissipation property, no possibility of an accidental fire, water resistance, humidity resistance and required rigidity.

Further, it is a second object of the present invention to provide a method of manufacturing a speaker voice-coil bobbin allowing the attainment of the first object.

To attain the first object, a speaker voice coil bobbin according to a first aspect of the present invention has the feature of including a material resulting from combining a ceramic-type-coating agent with a fiber-type material.

The speaker voice coil bobbin according to the first aspect is formed into an arbitrary shape by various methods; for example, the fiber-type material is formed into an arbitrary shape of the voice coil bobbin, and then combined with the ceramic-type-coating agent through impregnation or coating; the ceramic-type-coating agent is mixed into the beaten fiber-type material and the resulting combination is processed into paper; and the fiber-type material is beaten after being impregnated or coated with the ceramic-type-coating agent, and then the beaten fiber-type material is processed into paper.

According to the first aspect, the heat-dissipation effect of the ceramics which is combined into the fiber-type material serving as the base material of the speaker voice-coil bobbin offers a significant improvement of the efficiency of heat dissipation from the voice coil bobbin. The heat generated in the voice coil is changed into infrared radiation to be diverged efficiently from the total area of the outer and inner peripheral faces of the voice coil bobbin. Hence, it is possible to significantly reduce the effect of the heat upon the rest of the parts of the speaker, the adhesive and the like, leading to the prevention of the occurrence of an accidental fire originating in the speaker.

Further, the covering of all the surface of the voice coil bobbin with ceramics allows the voice coil bobbin to be incombustible or flame-retardant, even if a fiber-type material which has light weight and low cost but is flammable, such as paper, woven fabric and non-woven fabric, is used as the base material. This also prevents the speaker from bursting into flames as a result of the voice coil bobbin catching fire.

Further, the ceramics produced by the ceramic-type-coating agent combined with the fiber-type material increases the rigidity of the voice coil bobbin. Hence, it is possible to decrease the thickness of the voice coil bobbin for a reduction in weight.

Still further, the ceramics produced by the ceramic-type-coating agent combined with the fiber-type material improves humidity resistance and water resistance and strengthens the binding between the fibers. Hence, the environmental resistance including thermal resistance is improved, to allow the voice coil bobbin to be used in speakers which are placed in harsh environments where water is directly poured on the speaker or the temperature and humidity are high, as in the case of a vehicle-mounted speaker, for example.

To attain the first object, a speaker voice coil bobbin according to a second aspect of the present invention has the feature, in addition to the configuration of the first aspect, that the ceramic-type-coating agent is a ceramic-type-coating agent made up of at least one item selected from the group consisting of an alkoxy metal, a hydrolysate of the alkoxy metal and a partial condensation product of the hydrolysate.

With the speaker voice coil bobbin according to the second aspect, after the ceramic-type-coating agent made up of at least one item selected from the group consisting of an alkoxy metal, a hydrolysate of the alkoxy metal and a partial condensation product of the hydrolysate, is applied to the fiber-type material which is a base material of the voice coil bobbin, the ceramic-type-coating agent is hardened at room temperatures or by low-temperature heating, and undergoes hydrolysis and a polycondensation reaction, to product a ceramic film which is outstanding in heat-dissipation properties, noncombustiblity, thermal resistance and weather resistance, and also has a high water repellency and water proofing property due to its high density, and also electrical-insulation properties, and shock impact resistance due to its high degree of hardness.

To attain the first object, a speaker voice coil bobbin according to a third aspect has the feature, in addition to the configuration of the first aspect, that the ceramic-type-coating agent is a ceramic-type-coating agent made up of at least one item selected from the group consisting of mixtures of an alkoxy metal and a silicone varnish.

With the speaker voice coil bobbin according to the third aspect, the ceramic-type-coating agent made up of at least one item selected from the group consisting of mixtures of an alkoxy metal and a silicone varnish, which is combined with the fiber-type material serving as the base material of the voice coil bobbin, is hardened at room temperatures or by low-temperature heating, to form a ceramic film which has high heat-dissipation properties, noncombustibility, thermal resistance, weather resistance and electrical-insulation properties, and is outstanding in damage resistance due to its high degree of hardness.

To attain the first object, a speaker voice coil bobbin according to a fourth aspect has the feature, in addition to the configuration of the first aspect, that the ceramic-type-coating agent is a ceramic-type-coating agent made up of at least one item selected from the group consisting of mixtures of alkali metal salt and silicone varnish emulsion.

With the speaker voice coil bobbin of the fourth aspect, metal alkoxide and metal hydroxide are used for the ceramic-type-coating agent combined with the fiber-type material serving as the base material of the voice coil bobbin. The ceramic-type-coating agent includes a ceramic-type-coating agent made of metal alkoxide, metal hydroxide, and a colloidal or fine-particulate inorganic substance.

The ceramic-type-coating agent is hardened at room temperatures or by low-temperature heating, to produce a ceramic film which has noncombustibility, thermal resistance, weather resistance and electrical-insulation properties, and is outstanding in damage resistance due to its high degree of hardness.

To attain the first object, a speaker voice coil bobbin according to a fifth aspect has the feature, in addition to the configuration of the first aspect, that the ceramic-type-coating agent is a ceramic-type-coating agent including a colloidal inorganic substance or a fine-particulate inorganic substance having favorable heat-emission properties.

With the speaker voice coil bobbin according to the fifth aspect, the efficiency of heat-dissipation of the ceramics which, together with the base material, forms the shape of the voice coil bobbin, is more significantly improved due to the inclusion therein of a colloidal inorganic substance or a fine-particulate inorganic substance having favorable heat-emission properties. For this reason, the amount of heat-dissipation from the voice coil bobbin is increased, resulting in a greater reduction in the effect of the heat, generated by the passage of current through the voice coil, upon the other parts and so on.

A speaker voice coil bobbin according to a sixth aspect has the feature, in addition to the configuration of the fifth aspect, that the colloidal inorganic substance or the fine-particulate inorganic substance having favorable heat-emission properties is an impalpable powder of metal oxide having the property of converting heat into infrared rays for emission.

According to the speaker voice coil bobbin of the sixth aspect, due to the addition of the impalpable powder of metal oxide having the property of converting the heat into infrared rays for emission to the ceramic-type-coating agent, the efficiency of the heat-dissipation of the voice coil bobbin is considerably enhanced.

To attain the first object, a speaker voice coil bobbin according to a seventh aspect has the feature, in addition to the configuration of the first aspect, that the fiber-type material is selected from the group consisting of a paper-pulp based material, woven fabric and non-woven fabric.

According to the speaker voice coil bobbin of the seventh aspect, the paper-pulp based material is beaten for processing into paper, or the woven fabric or non-woven fabric is pressed, in order to form an arbitrary shape of the voice coil bobbin.

Due to the combining of the ceramic-type-coating agent with the paper-pulp based material, woven fabric or non-woven fabric, even when the voice coil bobbin is formed of the fiber-type material which is a flammable base material, it is possible for the voice coil bobbin to maintain heat-dissipation properties, noncombustibility or flame retardancy, water resistance, and humidity resistance.

To attain the second object, a method of manufacturing a speaker voice coil bobbin according to an eighth aspect of the present invention includes the step of forming a material resulting from combining a ceramic-type-coating agent with a fiber-type material into an arbitrary shape of the speaker voice coil bobbin.

According to the eighth aspect, the heat-dissipation effect of the ceramics which is combined into the fiber-type material serving as the base material of the speaker voice-coil bobbin offers a significant improvement of the efficiency of heat dissipation from the voice coil bobbin. The heat generated in the voice coil is changed into infrared radiation to be diverged efficiently from the total area of the outer and inner peripheral faces of the voice coil bobbin. Hence, it is possible to significantly reduce the effect of the heat upon the rest of the parts of the speaker, the adhesive and the like, leading to the prevention of the occurrence of an accidental fire originating in the speaker.

Further, the covering of all the surface of the voice coil bobbin with ceramics allows the voice coil bobbin to be incombustible or flame-retardant, even if a fiber-type material which has light weight and low cost but is flammable, such as paper, woven fabric and non-woven fabric, is used as the base material. This also prevents the speaker from bursting into flames as a result of the voice coil bobbin catching fire.

Further, the ceramics produced by the ceramic-type-coating agent combined with the fiber-type material increases the rigidity of the voice coil bobbin. Hence, it is possible to decrease the thickness of the voice coil bobbin for a reduction in weight.

Still further, the ceramics produced by the ceramic-type-coating agent combined with the fiber-type material improves humidity resistance and water resistance and strengthens the binding between the fibers. Hence, the environmental resistance including thermal resistance is improved, to allow the voice coil bobbin to be used in speakers which are placed in harsh environments where water is directly poured on the speaker or the temperature and humidity are high, as in the case of a vehicle-mounted speaker, for example.

To attain the second object, a method of manufacturing a speaker voice coil bobbin according to an ninth aspect of the present invention, in addition to the configuration of the eighth aspect, includes the steps of: forming the fiber-type material into an arbitrary shape of the voice coil bobbin; and impregnating or coating the fiber-type material, formed into the arbitrary shape of the voice coil bobbin, with the ceramic-type-coating agent in order to manufacture a speaker voice coil bobbin.

According to the method of manufacturing the speaker voice coil bobbin of the ninth aspect, for the formation into the shape of the voice coil bobbin, when the fiber-type material serving as the base material is paper, the pulp or beaten paper-fibers are processed into paper. When the fiber-type material is the woven fabric or non-woven fabric, the cloth sheet is pressed. The fiber-type material formed into the required shape of the voice coil bobbin is impregnated or coated with the ceramic-type-coating agent.

Then the ceramic-type-coating agent with which the shaped fiber-type material is impregnated or coated is solidified at room temperatures or by low-temperature heating so that the ceramics cover the surface of the fiber-type material.

To attain the second object, a method of manufacturing a speaker voice coil bobbin according to a tenth aspect, in addition to the configuration of the eighth aspect, includes the steps of: mixing the ceramic-type-coating agent into a fiber-type material in a separated fiber state before shaping; and processing the fiber-type material, mixed with the ceramic-type-coating agent, into paper for the formation of an arbitrary shape of a speaker voice coil bobbin in order to manufacture a speaker voice coil bobbin.

According to the method of manufacturing the speaker voice coil bobbin of the tenth aspect, the ceramic-type-coating agent which has been mixed into the fiber-type material and then processed into paper together with the fiber-type material, is solidified at room temperatures or by low-temperature heating so that the ceramics cover the surface of the fiber-type material formed into the shape of the voice coil bobbin.

To attain the second object, a method of manufacturing a speaker voice coil bobbin according to a eleventh aspect, in addition to the configuration of the eighth aspect, includes the steps of: impregnating or coating the fiber-type material with the ceramic-type-coating agent; beating the fiber-type material impregnated or coating with the ceramic type coating; and processing the beaten fiber-type material into paper for the formation into an arbitrary shape of a speaker voice coil bobbin in order to manufacture a speaker voice coil bobbin.

According to the method of manufacturing the speaker voice coil bobbin of the eleventh aspect, the ceramic-type-coating agent with which the fiber-type material is impregnated or coated is solidified at room temperatures or by low-temperature heating to produce the ceramic film. The resulting fiber-type material is beaten and the voice coil bobbin of the required shape is formed with the fibers on which the ceramic film is produced.

These and other objects and features of the present invention will become more apparent from the following detailed description with reference to the accompanying drawings.

BRIEF DESCRIPTION OF THE DRAWINGS

FIG. 2 is a table showing examples of composition of a ceramic-type-coating agent relating to the present invention.

FIG. 3 is a table showing the characteristics of a voice coil bobbin made from conventional materials and a voice coil bobbin according to the present invention.

DETAILED DESCRIPTION OF THE PREFERRED EMBODIMENT

A preferred embodiment according to the present invention will be described below.

Figure 1:
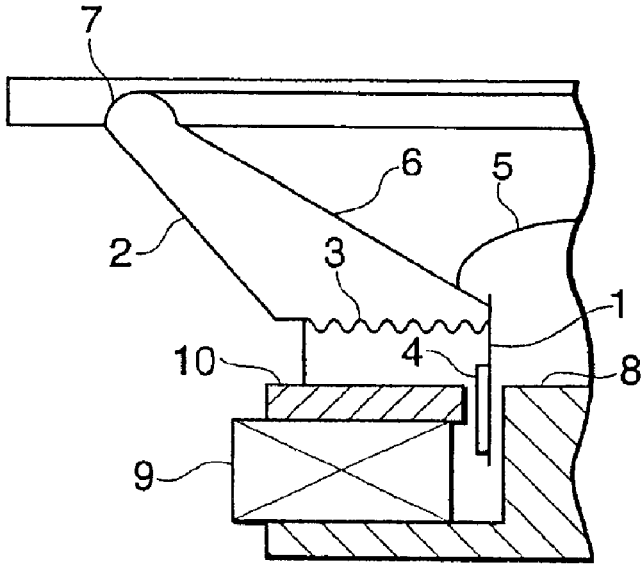
FIG. 1 is a sectional side view illustrating a configuration of a speaker mounted with a voice coil bobbin according to the present invention.

FIG. 1 is a partially sectional side view illustrating a configuration of a typical speaker mounted with a voice coil bobbin according to the present invention.

A cylindrical-shaped voice coil bobbin 1 is formed from a base material which has been subjected to treatment-processing by a manufacturing method according to the present invention as described later. The voice coil bobbin 1 is supported to vibrate in the axis direction thereof by a damper 3 which is interposed between the voice coil bobbin 1 and a frame 2 of the speaker.

A voice coil 4 is wound on the outer periphery of the voice coil bobbin 1.

FIG. 1 also illustrates a center cap 5 for covering an opening at one end of the voice coil bobbin 1, a diaphragm 6, an edge 7 for attaching the diaphragm to the frame 2, a yoke 8, a magnet 9, and a plate 10 for forming a magnetic field between the yoke and the plate.

To produce a material for forming the speaker voice-coil bobbin 1, a paper based material (e.g., a mixture consisting of a kraft pulp and a rigid pulp), woven fabric or non-woven fabric serving as a base material is combined with a ceramic by the process of impregnation or coating with a ceramic-type-coating agent.

The ceramic-type-coating agent to be combined with the base material in order to produce the material for forming the voice coil bobbin 1 consists of at least one item selected from the group consisting of an alkoxy metal, a hydrolysate of the alkoxy metal and a partial condensation product of the hydrolysate.

The alkoxy metal used in the present invention is hydrolyzed by the presence of water to result in a hydrolysate. The hydrolysate undergoes polycondensation to produce a partial polycondensation product to simply increase molecular weight to produce a thin film of metal oxide which is a complete condensation product.

The alkoxy metal is expressed by a general formula $M(OR)_n$ or $R'M(OR)_{n-1}$ (wherein M denotes Si, Al, Ti, and Zr, R denotes an alkyl group having the carbon number of 1 to 5 or an acyl group having the carbon number of 1 to 4, R' denotes an organic group having the carbon number of 1 to 8, and n denotes an integral number of 3 or 4), which includes a hydrolysate of the alkoxy metal and a partial condensation product thereof.

It is possible for such compounds to be a combination of one or more than one items and also to be a compound resulting from the condensation of more than one item.

Specific examples of the alkoxy metal include as follows: $Si(OCH_3)_4$, $Si(OC_2H_5)_4$, $Si(OC_3H_7)_4$, $Si(OC_4H_9)_4$, $CH_3Si(OCH_3)_3$, $CH_3Si(OC_2H_5)_3$, $CH_3Si(OC_3H_7)_3$, $CH_3Si(OC_4H_9)_3$, $C_2H_5Si(OCH_3)_3$, $C_2H_5Si(OC_2H_5)_3$, $C_2H_5Si(OC_3H_7)_3$, $C_2H_5Si(OC_4H_9)_3$, $Al(OCH_3)_3$, $Al(OC_2H_5)_3$, $Al(OC_3H_7)_3$, $Al(OC_4H_9)_3$, $CH_3Al(OCH_3)_2$, $CH_3Al(OC_2H_5)_2$, $CH_3Al(OC_3H_7)_2$, $CH_3Al(OC_4H_9)_2$, $C_2H_5Al(OCH_3)_2$, $C_2H_5Al(OC_2H_5)_2$, $C_2H_5Al(OC_3H_7)_2$, $C_2H_5Al(OC_4H_9)_2$, $Ti(OCH_3)_4$, $Ti(OC_2H_5)_4$, $Ti(OC_3H_7)_4$, $Ti(OC_4H_9)_4$, $CH_3Ti(OCH_3)_3$, $CH_3Ti(OC_2H_5)_3$, $CH_3Ti(OC_3H_7)_3$, $CH_3Ti(OC_4H_9)_3$, $C_2H_5Ti(OCH_3)_3$, $C_2H_5Ti(OC_2H_5)_3$, $C_2H_5Ti(OC_3H_7)_3$, $C_2H_5Ti(OC_4H_9)_3$.

Such alkoxy metal is, in a typical use, dissolved or dispersed in an organic solvent, water, a mixed solvent of the organic solvent and water, or the like, and if the alkoxy metal itself is in liquid form, it can be used as it is.

The alkoxy metal may have a solid concentration of the order of a range of from 10 wt % to 100 wt % in ordinary cases. The proportion of the alkoxy metal in the ceramic-type-coating agent ranges from 6 parts by weight to 30 parts by weight in solid conversions. Less than 6 parts by weight of the alkoxy metal is undesirable because it causes an insufficient thickness of the film, low hardness and low bonding force, whereas more than 30 parts by weight causes the film to be apt to splinter or to become a powder state.

The aforementioned organic solvent is used as a concentration adjustor and a hardening-rate adjustor for the alkoxy metal, and as a dispersion medium for fine-particulate inorganic substance. Examples of those used for producing the organic solvent include: lower alcohols such as methanol, ethanol, propanol and butanol; hydrocarbon ether alcohols, such as ethylene glycol monoalkylether, diethylene glycol monoalkylether, and propylene glycol monoalkylether, having methyl, ethyl, propyl, butyl and the like serving as alkyl groups; and hydrocarbon ether acetates, such as ethylene glycol monoalkylether acetate, diethylene glycol monoalkylether acetate, and propylene glycol monoalkylether acetate.

As a solvent for the ceramic-type-coating agent, it is possible to use: acetic esters of ether alcohol or the like; acetic esters of alcohols, such as ethoxy ethyl acetate; esters such as methyl acetate, ethyl acetate, propyl acetate, and butyl acetate; acetone; and the like.

A second example of the ceramic-type-coating agent according to the present invention consists of at least one item selected from the group consisting of mixtures of the alkoxy metal and a silicone varnish.

This is consists of a mixture of the foregoing alkoxy metal and a pure silicone varnish which is expressed by a general formula $(R'_2Si)_n(OR)_2$ (wherein R' denotes an organic group having the carbon number of 1 to 8, and R denotes an alkyl group having the carbon number of 1 to 5 or an acyl group having the carbon number of 1 to 4), which produces a flexible coating film used as a bonding material for the aforementioned ceramic-type-coating agent. When the alkyl group is methyl, the thermal resistance and water repellency are enhanced.

Such a mixture of the alkoxy metal and silicone varnish may be in the proportion of a range of from 10 to 70 parts by weight to a range of from 30 to 90 parts by weight (100 parts by weight in total)in solid conversions. The proportion of the mixture in the ceramic-type-coating agent ranges from 15 to 50 parts by weight in solid conversions, in which less than 15 parts by weight is undesirable because it causes an insufficient thickness of the film and a low bonding force, whereas more than 50 parts by weight causes the film to be apt to splinter or to have an extremely high viscosity.

A third example of the ceramic-type-coating agent according to the present invention consists of at least one item selected from the group consisting of mixtures of an alkali metal salt and a silicone varnish emulsion.

This consists of a mixture of alkali metal salt, which is expressed by a general formula $M'_2O{\cdot}nM{\cdot}mH_2O$ (wherein M' denotes Na, Li, K, and $NR_4$, M denotes $SiO_2$, $Al_2O_3$, $TiO_2$ and $ZrO_2$, n and m denote an integral number), and a silicone varnish which after emulsification displays an alkaline pH, which is used as an aqueous bonding agent for the foregoing ceramic-type-coating agent to produce a flexible and heat-resistant film.

Such a mixture of the alkali metal salt and silicone varnish may be in the proportion of a range of from 10 to 60 parts by weight to a range of from 40 to 90 parts by weight (100 parts by weight in total) in solid conversions. The proportion of the mixture in the ceramic-type-coating agent ranges from 15 to 40 parts by weight in solid conversions, in which less than 15 parts by weight is undesirable because it causes an insufficient thickness of the film and a low bonding force, whereas more than 40 parts by weight causes the film to be apt to splinter or to have an extremely high viscosity.

After the ceramic-type-coating agent is applied to the base material such as paper, woven fabric or non-woven fabric, the ceramic-type-coating agent is hardened at room temperatures or by low-temperature heating, and undergoes hydrolysis and a polycondensation reaction. The resulting agent has the property of forming a ceramic film which is noncombustible and outstanding in its thermal resistance and weather resistance, and has a high water repellency and water proofing property due to its high density, and also electrical-insulation properties and shock impact resistance due to its high degree of hardness.

The ceramic-type-coating agent has flexibility to a certain extent when solidified. Hence, the use of the ceramic-type-coating agent allows the prevention of the voice coil bobbin from becoming brittle.

Figure 6:
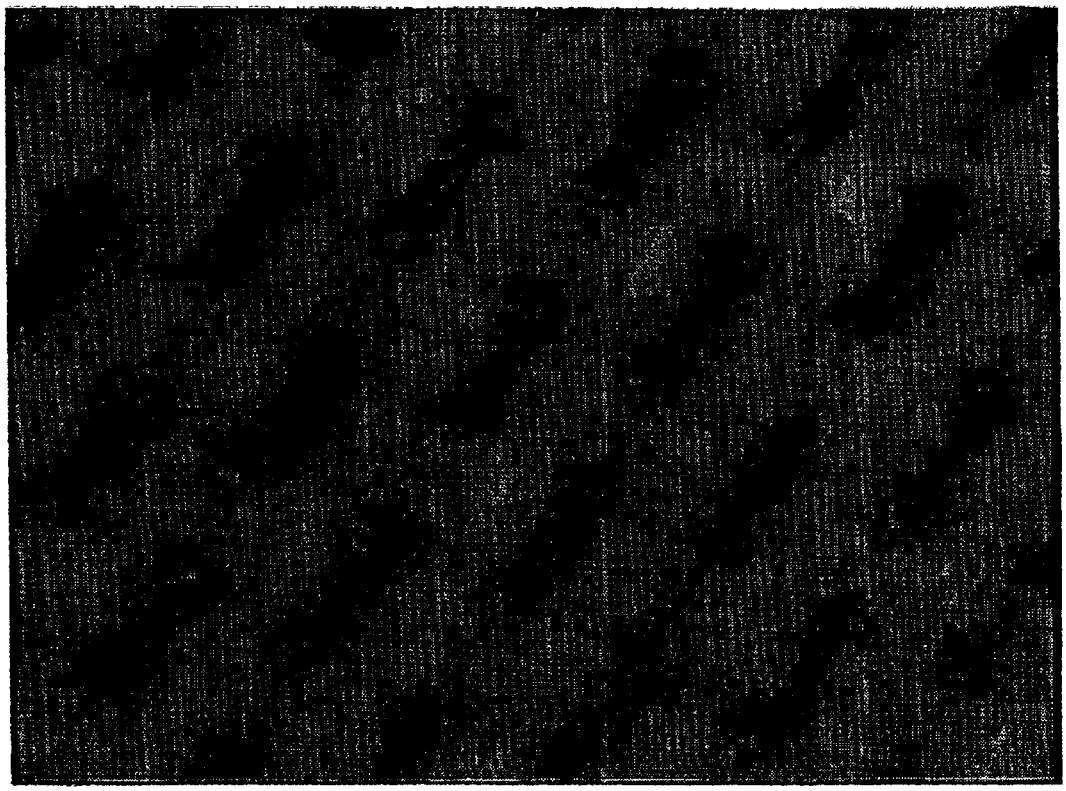
FIG. 6 is a photograph of a surface of a voice coil bobbin including a glass cloth coated with metal alkoxide.

FIG. 6 is a photograph of the surface of the voice coil bobbin including a glass cloth coated with the metal alkoxide.

Next, a description will be given of a method of manufacturing a speaker voice-coil bobbin with the use of the foregoing various ceramic-type-coating agents.

For the manufacture of the speaker voice-coil bobbin, besides using the ceramic-type-coating agent as described above, other ceramic-type-coating agents having properties similar to it can be also used.

With a method of manufacturing the speaker voice-coil bobbin in a first example, a fabric system material such as: paper; glass fiber; aramid fiber; metal oxide fiber or silica-alumina fiber, such as alumina fiber; liquid crystal polymer fiber; acrylic fiber; metal fiber; ceramic fiber; silicon carbide fiber; boron fiber; amorphous fiber; or fluorine fiber, is formed into a required shape of the voice coil bobbin. Then, the material formed into the required shape of the voice coil bobbin is impregnated or coated with the ceramic-type-coating agent.

In the formation of the voice coil bobbin from the fiber-type material, when the material is paper, the pulp or fibers of the beaten paper are processed into paper. When the material is the woven fabric or non-woven fabric, the cloth sheet is pressed. The fiber-type material formed into the required shape of the voice coil bobbin is impregnated or coated with the ceramic-type-coating agent.

In the above manufacturing method, it is possible to apply the ceramic-type-coating agent to the fiber material by a roll coat technique, a dip technique, a spray technique, a curtain flow technique, a printing technique, or the like.

After the coating process, the drying and hardening of the coating film can proceed under room temperatures, but the application of heat reduces the drying time and effects a higher density in polymerization, leading to a denser ceramic layer. The heating conditions are 5 minutes to 60 minutes at 100 degrees C. to 300 degrees C., preferably, 10 minutes to 30 minutes at 150 degrees C. to 250 degrees C.

In order to enhance the electrical-insulation properties in the ceramic layer, it is desirable that after the coating and drying or the heat-drying of the ceramic-type-coating agent, the ceramic-type-coating agent is simply re-applied in one layer or more, and then dried and hardened to form two ceramic layers or more.

The coating weight of the ceramic-type-coating agent ranges from 20 parts by weight to 80 parts by weight per square meter in solid conversions, in which less than 20 parts by weight is undesirable because it causes an extremely small thickness of the film, leading to an insufficiency of electrical-insulation properties or reduced heat-emission properties, whereas more than 80 parts by weight causes the coating film to be apt to splinter or to have thermal insulation properties.

With the above method, the ceramic-type-coating agent with which the shaped fiber-type material is impregnated or coated is solidified at room temperatures or by low-temperature heating so that the ceramics cover the surface of the fiber-type material.

Figure 4:
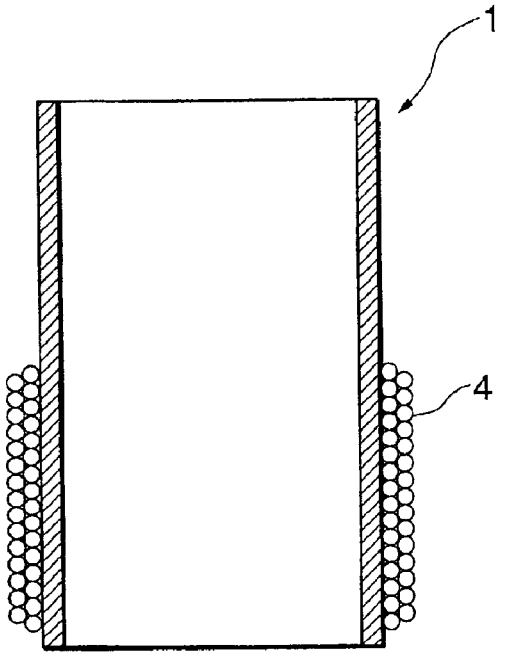
FIG. 4 is a sectional side view illustrating an example of an embodiment of the voice coil bobbin according to the present invention.

FIG. 4 illustrates the situation when the fiber-type material formed into the shape of the voice coil bobbin has been impregnated with the ceramic-type-coating agent, and the fiber-type material constituting the voice coil bobbin 1 has solidified together with the ceramic-type-coating agent.

Figure 5:
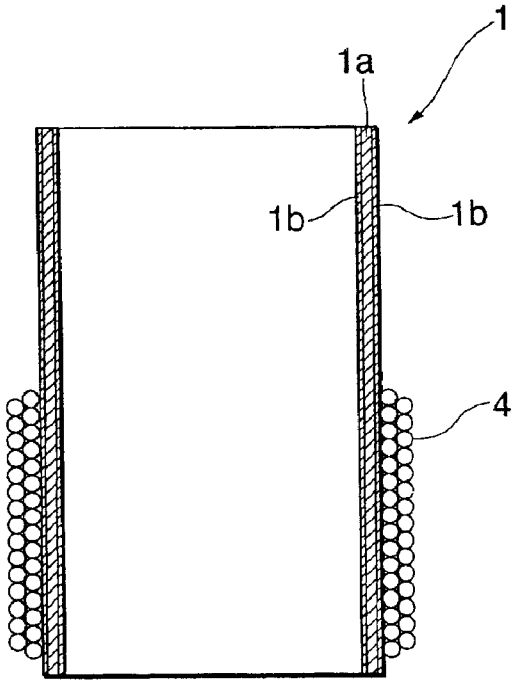
FIG. 5 is a sectional side view illustrating another example of an embodiment of the voice coil bobbin according to the present invention.

FIG. 5 illustrates the situation when the fiber-type material la formed into the shape of the voice coil bobbin has been coated on its outer and inner peripheral faces with the ceramic-type-coating agent, and a ceramic film 1*b* has been formed on the outer and inner peripheral faces of the fiber-type material.

In a method of manufacturing a speaker voice-coil bobbin in a second example, before proceeding to shaping of the voice coil bobbin, the ceramic-type-coating agent is mixed into the fibers of the fiber-type material such as pulp, beaten paper or the like, and then the fibers of the material mixed equally with the ceramic-type-coating agent are processed into paper for the formation into the required shape of the voice coil bobbin.

With the above method, the fibers of the material together with the ceramic-type-coating agent mixed therein are formed into the voice coil bobbin of the required shape. Then the ceramic-type-coating agent together with the fiber-type material is solidified at room temperatures or by low-temperature heating.

The voice coil bobbin manufactured by the method of the second example results in a similar condition to that illustrated in FIG. 4.

In a third example of the method of manufacturing the speaker voice coil bobbin, the fiber-type material such as paper is impregnated or coated with the ceramic-type-coating agent in advance. The fiber-type material impregnated or coated with the ceramic-type-coating agent is beaten. Then the fibers are processed into paper for formation into the required shape of the voice coil bobbin.

With the above method, the ceramic-type-coating agent with which the fiber-type material is impregnated or coated is solidified at room temperatures or by low-temperature heating to produce a ceramic film. The resulting fiber-type material is beaten and then the voice coil bobbin of the required shape is formed by the fibers on which the ceramic film is produced.

With each of the voice coil bobbins manufactured by the individual manufacturing methods as described above, the surface of the base material is covered with the ceramics. Therefore, the heat-emission effect of the ceramics combined with the base material offers a significant improvement of the efficiency of heat dissipation from the voice coil bobbin. The heat generated in the voice coil is changed into infrared radiation to be diverged efficiently from the total surface including the outer and inner peripheral faces of the voice coil. Hence, it is possible to significantly reduce the effect of heat upon the rest of the parts of the speaker, the adhesive and the like, leading to the prevention of the occurrence of an accidental fire originating in the speaker.

In another proposed example of the voice coil bobbin according to the present invention, a ceramic-type-coating agent, as used in the individual manufacture methods described above, includes a colloidal inorganic substance or a fine-particulate inorganic substance having favorable heat-emission properties.

The colloidal or fine-particulate inorganic substance is used for improving the heat-emission properties of the coating film formed by the foregoing ceramic-type-coating agent to promote heat-dissipation from the voice coil bobbin. The amount of heat-emission is proportional to the product of an emissivity and an emission area, in which the particle diameter of the inorganic substance is of the utmost importance.

The colloidal inorganic substance has particles of the order of 10 angstroms to 10.000 angstroms which are dispersed in a dispersion medium. For the dispersion medium, in most instances, water or an organic solvent of a lower alcohol, a hydrocarbon, ethyl alcohols, acetic esters related to the lower alcohol, hydrocarbon or ethyl alcohols, or the like is used alone or in combination. The concentration of dispersion particles is commonly in a range of from 10 parts by weight to 60 parts by weight.

Specific examples of the colloidal inorganic substance are colloidal alumina, colloidal silica, colloidal zirconia, colloidal titania, colloidal cerium oxide, colloidal zirconium silicate, colloidal aluminum hydroxide, colloidal zirconium hydroxide, and the like.

A proper fine-particulate inorganic substance has favorable heat-emission properties and a particle diameter of the order of from 0.1 micro to 3.0 micro, of which examples include: metal oxide such as alumina, zirconia, titania, iron oxide, copper oxide, manganese oxide, nickel oxide, chromium oxide, cobalt oxide or the like; a synthetic thereof; aluminium silicate; zirconium silicate; aluminum hydroxide; zirconium hydroxide; and silicon nitride. And it is also possible to use a fibrous inorganic substance, e.g., potassium titanate, silicon nitride and aluminum oxide, having a diameter of the order of from 0.1 micro to 3.0 micro and a length of the order of from 5 micro to 20 micro.

The proportion of the colloidal or fine-particulate inorganic substance in the foregoing ceramic-type-coating agent ranges from 2 parts by weight to 20 parts by weight in solid conversions, in which less than 2 parts by weight is undesirable because it causes a reduction in heat-emission properties, whereas more than 20 parts by weight causes development of thermal-insulation properties.

For the ceramic-type-coating agent, various surface-active agents, various catalytic hardeners, an organic/inorganic acid, or the like can be used.

The ceramic-type-coating agent may include a mixture of the colloidal inorganic substance and the fine-particulate inorganic substance.

FIG. 2 shows composition examples (1 to 3) of the ceramic-type-coating agent according to the present invention.

A colloidal inorganic substance or a fine-particulate inorganic substance having favorable heat-emission properties can be produced from an impalpable powder of a variety of metal oxides having a high emissivity and the property of converting heat into infrared radiation for emission.

In the example, the voice coil bobbin is made up of the added colloidal inorganic substance or fine-particulate inorganic substance having favorable heat-emission properties together with the base material and the ceramic-type-coating agent. Hence, the efficiency of heat dissipation from the voice coil bobbin is significantly improved.

FIG. 3 shows the characteristics of a voice coil bobbin made from conventional materials and a voice coil bobbin according to the present invention, from which it can be seen that the voice coil bobbin of the present invention shows favorable values in all the characteristics concerning specific gravity, Young's modulus and internal loss.

Further in the voice coil bobbins manufactured by the respective manufacturing methods as described above, the ceramics covers the surface of the base material which is, e.g., a fiber-type material, such as a paper based material, woven fabric and non-woven fabric, having flammability and moisture absorbing and water absorbing properties. For this reason, even with the use of a lightweight material of low cost, the voice coil bobbin is permitted to have heat resistance (heat-resistant to temperatures of 500 degrees C. or higher) and, noncombustibility or flame retardancy. This allows an increase of withstand input-power. Hence, even when an abnormal current flows through the voice coil or when abnormal heating occurs on the periphery thereof, the speaker can be prevented from bursting into flames as a result of the voice coil bobbin catching fire.

Further, the solidification of the ceramic-type-coating agent combined with the base material increases the rigidity of the voice coil bobbin. For this reason, the thickness of the voice coil bobbin can be decreased, resulting in the provision of a lightweight voice coil bobbin.

Selectively adjusting the composition or concentration of the ceramic-type-coating agent achieves the provision of a voice coil bobbin in accordance with the characteristics of the speaker.

Still further, the voice coil bobbins manufactured by each the aforementioned manufacturing methods is designed so that the ceramics cover the surface of the base material forming the voice coil bobbin, which offer an improvement in humidity resistance and water resistance and the strength of the binding between the fibers, leading to satisfactory environmental resistance. Also, the constituents do not dissolve in water. Accordingly, it is possible to use the voice coil bobbins in speakers which are placed in harsh environments where water is directly poured on them or the temperature and humidity are high, as in the case of a vehicle-mounted speaker, for example.

Still further, the voice coil bobbin manufactured by each of the aforementioned manufacturing methods is decreased in thermal conductivity due to the ceramics being combined with the base material forming the voice coil bobbin. Thus, it is possible to prevent the heat, which is generated by the passage of current through the voice coil, from being propagated through the adhesive and the rest of the parts coupled with the voice coil bobbin, to the occurrence of deformation or deterioration of the parts and the adhesive.

The terms and description used herein are set forth by way of illustration only and are not meant as limitations. Those skilled in the art will recognize that numerous variations are possible within the spirit and scope of the invention as defined in the following claims.

What is claimed is:

1. A speaker voice coil bobbin, comprising a material resulting from combining a ceramic coating agent with a fibrous material, wherein the fibrous material is impregnated with the ceramic coating agent, and wherein the ceramic coating agent is a ceramic coating agent made up of at least one item selected from the group consisting of mixtures of an alkoxy metal and a silicone varnish.

2. A speaker voice coil bobbin according to claim 1, wherein said ceramic coating agent is a ceramic coating agent also made up of at least one item selected from the group consisting of an alkoxy metal, a hydrolysate of the alkoxy metal and a partial condensation product of the hydrolysate.

3. A speaker voice coil bobbin comprising a material resulting from combining a ceramic coating agent with a fibrous material, wherein the fibrous material is impregnated with the agent, and, wherein said ceramic coating agent is a ceramic coating agent made up of at least one item selected from the group consisting of mixtures of alkali metal salt and silicone varnish emulsion.

4. A speaker voice coil bobbin according to claim 1, wherein said ceramic coating agent is a ceramic coating agent including a colloidal inorganic substance or a fine-particulate inorganic substance having favorable heat-emission properties.

5. A speaker voice coil bobbin according to claim 4, wherein said colloidal inorganic substance or said fine-particulate inorganic substance having favorable heat-emission properties is an impalpable powder of metal oxide having the property of converting heat into infrared rays for emission.

6. A speaker voice coil bobbin according to claim 1, wherein said fibrous material is selected from the group consisting of a paper-pulp based material, woven fabric and non-woven fabric.

* * * * *